United States Patent [19]

Jinbo et al.

[11] Patent Number: 4,766,459

[45] Date of Patent: Aug. 23, 1988

[54] APPARATUS FOR SEPARATING TRANSFER PAPER FROM PHOTOSENSITIVE MEMBER OF COPYING MACHINE

[75] Inventors: Masato Jinbo, Nashiki; Kenji Kojima, Tokyo, both of Japan

[73] Assignee: Ricoh Company, Ltd., Tokyo, Japan

[21] Appl. No.: 880,899

[22] Filed: Jul. 1, 1986

[30] Foreign Application Priority Data

Jul. 10, 1985 [JP] Japan ..... 60-149926

[51] Int. Cl.[4] ..... G03G 21/00

[52] U.S. Cl. ..... 355/3 SH; 271/307; 271/311; 271/900

[58] Field of Search ..... 355/3 SH, 3 R, 16; 271/311, 312, 307, 308, 310, 313, 900

[56] References Cited

U.S. PATENT DOCUMENTS

| | | | |
|---|---|---|---|
| 3,936,045 | 2/1976 | Ariyama | 271/900 |
| 4,159,172 | 6/1979 | Tani | 355/3 TR |
| 4,179,116 | 12/1979 | Umezawa et al. | 271/900 |
| 4,269,504 | 5/1981 | Landa | 355/3 SH |
| 4,278,341 | 7/1981 | Burgess | 355/3 SH |
| 4,351,601 | 9/1982 | Cormier et al. | 355/3 TR |
| 4,387,981 | 6/1983 | Cormier | 271/900 |
| 4,420,243 | 12/1983 | Baker | 355/3 TR |
| 4,470,689 | 9/1984 | Nomura et al. | 355/3 R |
| 4,616,920 | 10/1986 | Itoigawa et al. | 355/3 BE |

*Primary Examiner*—R. L. Moses

*Attorney, Agent, or Firm*—Cooper & Dunham

[57] ABSTRACT

A transfer paper separating apparatus for separating transfer paper attracted by a photosensitive member of a copying machine from the photosensitive member is disclosed, in which the front edge of the transfer paper is peeled off from the photosensitive member by a pick-off blade and then the transfer paper is separated therefrom by a separation belt and a separation roller. The separation belt and the pick-off blade are mounted on a first support plate and the separation roller is mounted on a second support plate, and the first and second support plates are movable away from the photosensitive member independently each other.

9 Claims, 4 Drawing Sheets

APPARATUS FOR SEPARATING TRANSFER PAPER FROM PHOTOSENSITIVE MEMBER OF COPYING MACHINE

FIELD OF THE INVENTION

The present invention relates to an apparatus for separating a transfer paper attracted to a photosensitive member of a copying machine or a facsimile machine from the photosensitive member.

RELATED ART STATEMENT

FIG. 1 shows, schematically, a conventional apparatus for separating a transfer paper from a photosensitive member, i.e., photosensitive drum of a copying machine from the drum. In FIG. 1, a transfer paper 16 sent out from a paper supply tray 50 is carried by registration rollers 2 and 3 to a photosensitive drum 1, while being guided by guide plates 6 and 7.

A pick-off blade 12 supported by fixing members 14 and 15 fixedly secured to a main body of a copying machine which is not shown is provided on a surface of the photosensitive drum 1. A wire 5 for holding the transfer paper is provided in the vicinity of the guide plates 6 and 7. The transfer paper 16 passed through the guide plates 6 and 7 is moved upwardly along the surface of the photosensitive drum 1 while one side edge thereof is urged against the pick-off blade 12 by the wire 5.

A front edge of the moving transfer paper is peeled off from the photosensitive drum 1 by a peeling-off portion **12*a* formed by bending a portion of the pick-off blade 12 radially outwardly and, then, moved by a separation roller 8 and a separation belt 9 away from the photosensitive drum 1. Thus, the whole of the transfer paper is separated from the photosensitive drum 1. The transfer paper thus separated from the drum is sent out a guide plate 17**.

In the machine of this type, when a jam of paper occurs, the separation belt 9 is rotated clockwisely around a fulcrum **11*a* by pushing a lever 21 provided integrally with the belt 9 in a direction shown by an arrow A. Further, the guide plate 17** is rotated in a direction shown by an arrow B, to facilitate removal of the jammed paper.

However, since it is impossible to sufficiently separate the separator roller 8 from the separation belt 9 by merely rotating the separation belt 9 through the lever 21, there may be some portion thereof left in non-separated state. In such case, the removal of jammed paper may not be easy and there may be a drop-out of the separation belt 9 during the removing operation. Further, it is impossible to provide a space large enough to remove the jammed paper by rotating the guide plate 17. In addition, since the transfer charger 4 and the registration rollers 2 and 3 are fixed in position with respect to the photosensitive drum 1, the removal of jammed paper must be done against a considerable friction, which may tear the jammed paper, leaving a piece of paper in the machine.

In the transfer paper separation device of this type, since the separation belt 9 and the pick-off blade 12 are fixedly secured to the body of the copying machine, a cleaning and/or replacing operation of the separation belt is relatively difficult.

SUMMARY OF THE INVENTION

An object of the present invention is to provide a transfer paper separating device which facilitates removal of jammed paper and replacement and/or cleaning of components such as a separation belt or a pick-off blade thereof.

The above object can be achieved, according to the present invention, by providing a peeling-off member for separation the front edge of transfer paper from a photosensitive member, a transfer paper transporting means for transporting the transfer paper having its front edge separated from the photosensitive member such that it is separated from the latter and a support plate mounted detachably to the body of a copying machine for supporting the transfer paper transporting means and a separation member.

DETAILED DESCRIPTION OF PREFERRED EMBODIMENT

Figure 1:
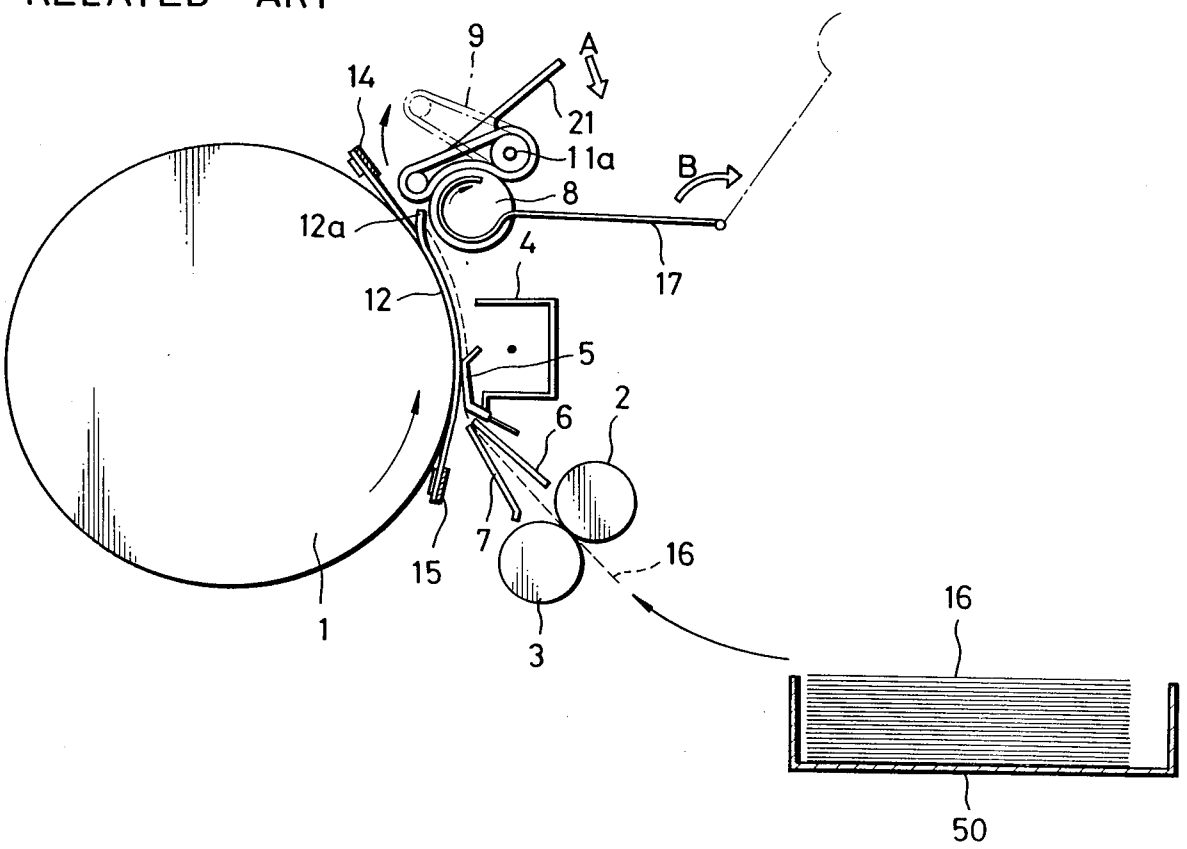
FIG. 1 RELATED ART
FIG. 1 is a side view of a transfer paper separating device related to the present invention.
Figure 2:
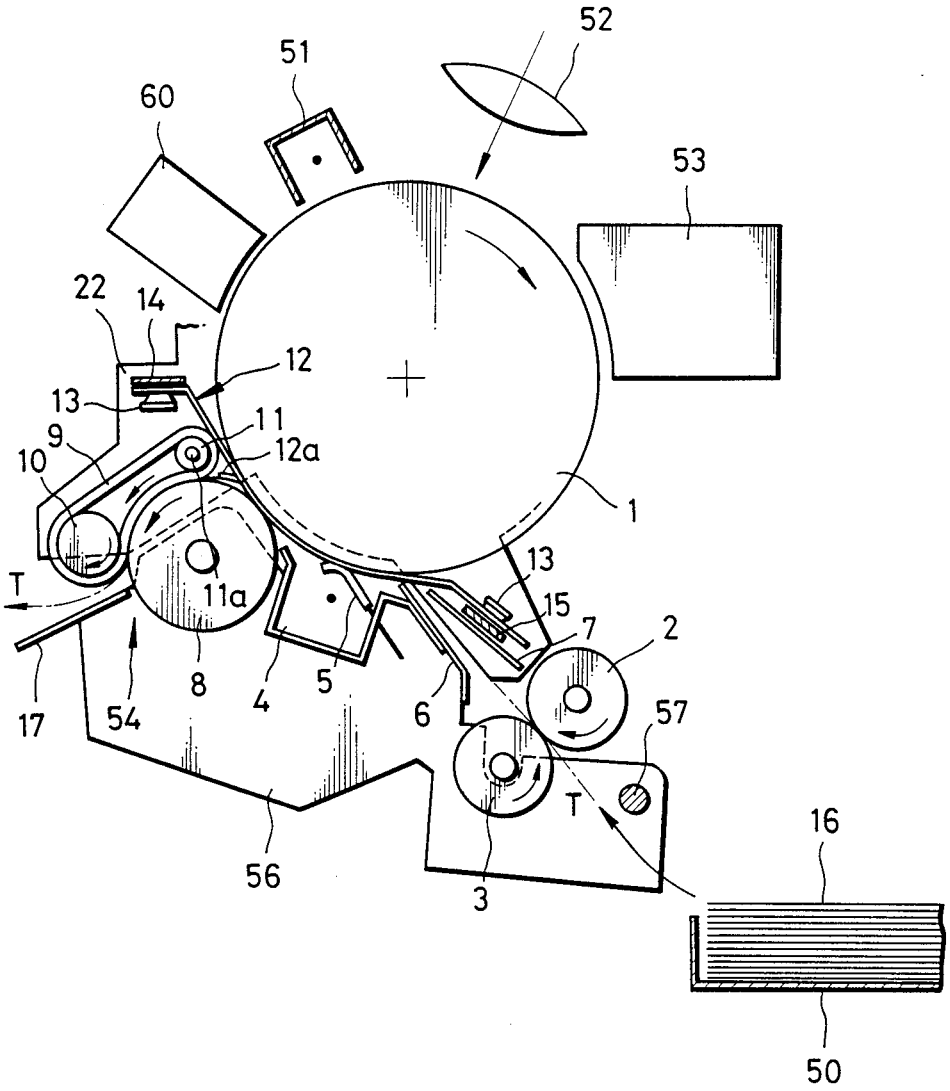
FIG. 2 is a side view of a portion of a copying machine having a transfer paper separating device according to an embodiment of the present invention.

In FIG. 2, around a photosensitive member 1, in the form of drum, a charger 51 for charging the photosensitive member 1, an exposing optical system 52, a developing device 53, a transfer charger 4, a pick-off blade 12 and a transfer paper transporting means 54 are arranged in the order shown, along a direction of clockwise rotation of the drum. The transfer paper transporting means 54 includes a separation roller 8 rotatably driven counterclockwise and a separation belt 9 in frictional contact with the separation roller 8.

A surface of the photosensitive drum 1 is charged uniformly by the charger 51 and then exposed with an image by the optical system 52. An electrostatic latent image is thus formed of the surface of the drum 1. The latent image is developed by the developing device 53, resulting in a visible image on the surface, which is transported to the transfer charger 4 by rotation of the photosensitive drum 1.

During this operation, a transfer paper 16 stored in a paper supply tray 50 is sent to the photosensitive drum 1 by the registration rollers 2 and 3, properly timed to the movement of the visible image on the photosensitive drum 1, and after it passes through a gap between an upper guide plate 7 and a lower guide plate 6, it is placed on the visible image on the drum 1 in the area of the transfer charger 4, where the visible image is transferred to the transfer paper under the discharge condition produced by the transfer charger 4. While the transfer paper having the image thereon is moved along by the rotation of the photosensitive drum 1, its front (leading) edge is peeled off from the drum 1 by a peeling member **12*a* of the pick-off blade 12 and sent in between the separation belt 9 and the separation roller 8. Thus, the transfer paper is separated from the photosensitive drum 1 and sent to a guide plate 17**.

The pick-off blade 12, the separation belt 9 and the upper guide plate 7 are mounted on an upper support plate 22 arranged behind the photosensitive drum 1 in the view of FIG. 2. On the other hand, the guide plate 17, the separation roller 8, the transfer charger 4, a pressing wire 5, the lower guide plate 6 and the lower registration roller 3 are mounted on a lower support plate 56. The upper support plate 22 is detachably mounted to the body (not shown) of a copying machine, which supports the photosensitive drum 1, in an axial direction of the drum 1. The lower support plate 56 is mounted on the body rotatably around a pin 57.

An assembling procedure of the pick-off blade 12, the upper support plate 22, the peeling roller 8 and the lower support plate 56, etc., will be described in detail.

Figure 3:
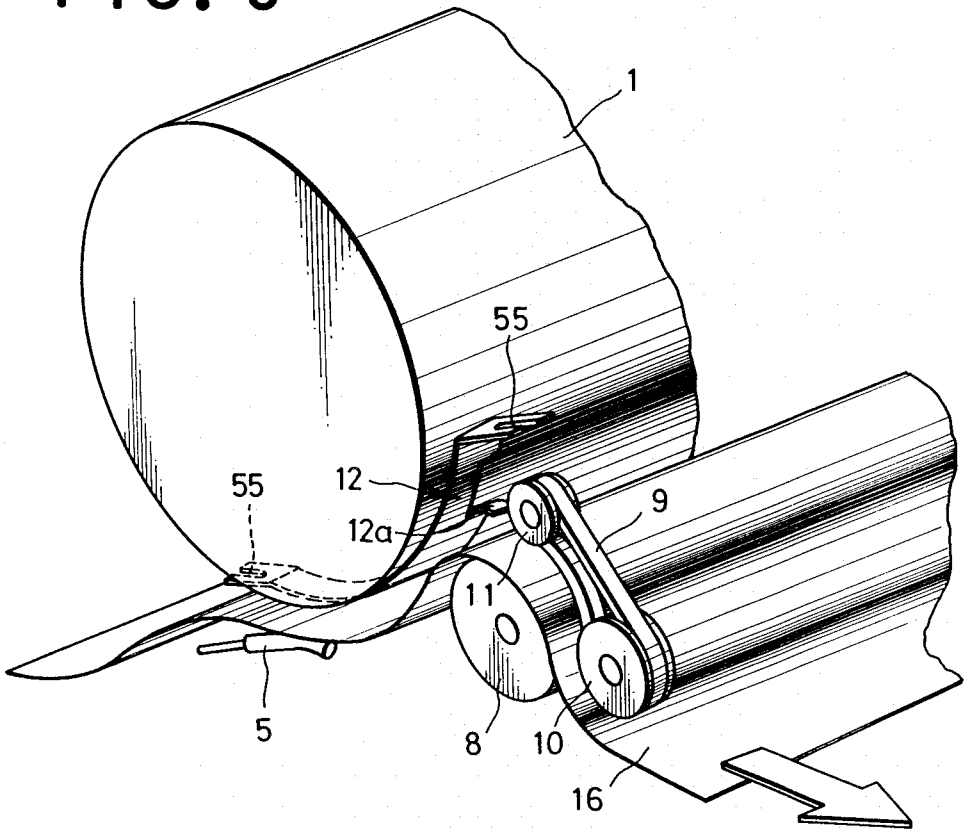
FIG. 3 is a perspective view of a portion of the device including a pick-off blade.
Figure 4:
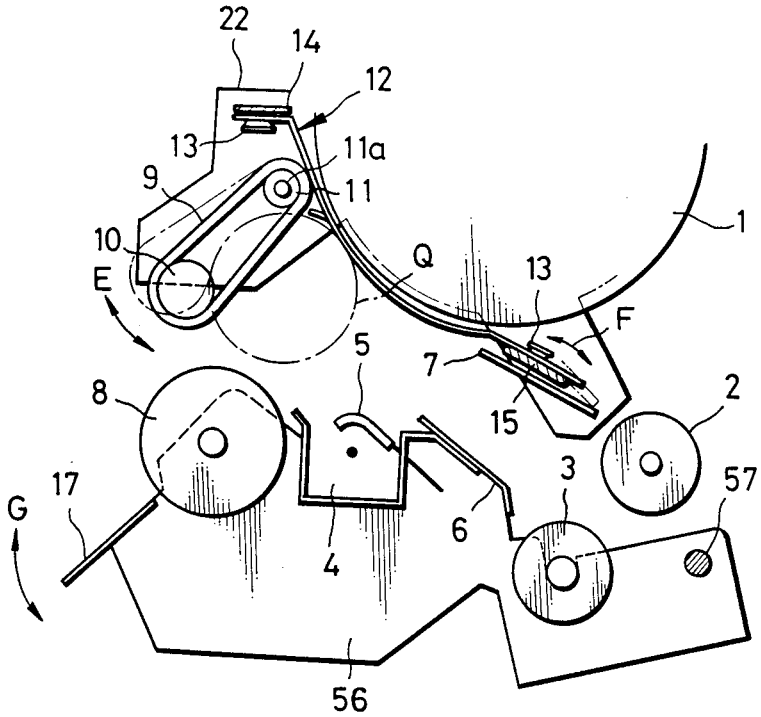
FIG. 4 is a side view showing a state where a second support member is moved.

As shown in FIG. 3, the pick-off blade 12 is formed in an upper end portion and a lower end portion thereof with respective notches 55. The upper support plate 22 supports upper and lower support members 14 and 15 each being formed with a hook 13, as shown in FIG. 2. The pick-off blade 12 is mounted on the upper support plate 22 by hooking the notches 55 thereof with the hooks 13, respectively. The upper support member 14 is integrally formed on the upper support plate 22 and the lower support member 15, together with the upper guide plate 7, is swingable in directions shown by arrows F with respect to the upper support plate 22, as shown in FIG. 4. In FIG. 4, the lower support member 15 is shown swung leftwardly from its position shown in FIG. 2, in which the pick-off blade 12 is separated from a surface of the photosensitive drum 1. Although not shown, the lower support member 15 is associated with a tension member such as spring by which the member 15 is biased leftwardly as shown in FIG. 4.

Figure 5:
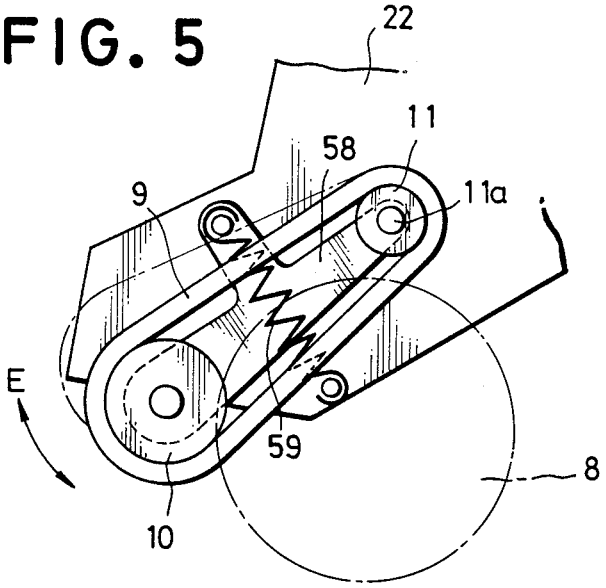
FIG. 5 shows, in enlarged scale, the portion shown in FIG. 3.

The separation belt 9 is provided between a pulley 11 and a larger pulley 10 which are supported by a lever plate 58. The lever plate 58 is pivotable, as shown by arrows E, around a pin 11*a* which also constitutes a rotation center of the pulley 11, as shown in FIG. 4. The separation belt 9 is biased downwardly by a spring 59 provided between the lower support plate 22 and a pin formed on the lever plate 58, as shown in FIG. 5.

The separation roller 8, the transfer charger 4, the pressing wire 5, the lower guide plate 6 and the lower registration roller 3 are mounted at predetermined positions on the lower support plate 56, respectively, as shown in FIG. 4. Therefore, when the lower support plate 56 is pivotted around the pin 57 in directions shown by arrows G, the respective members on the lower support plate are moved with respect to the photosensitive drum 1. It should be noted that the downward pivot of the separation belt 9 is limited to the state shown by a solid line in FIG. 4. In the position of the separation belt 9 shown by the solid line in FIG. 4, a shift of the separation roller 8 toward the photosensitive drum 1 is allowed, regardless of the presence of the lower support plate 56, when the separation roller 8 is lifted up by the lower support plate 56.

When the separation roller 8 moves toward the photosensitive drum 1, a portion of the separation belt 9 which is on the larger pulley 10 contacts firstly with the separation roller 8, causing the whole of the separation belt 9 to be pivotted upwardly against an influence of the spring 59. When the separation roller 8 reaches a predetermined operating position Q shown by a chain line, the belt 9 is slightly returned downwardly, so that it is maintained in this position where the belt 9 and the roller 8 are in contact with each other, with a desired frictional relation therebetween as shown in FIG. 2.

The process including the formation of the electrostatic latent image on the photosensitive drum 1, the transfer of the visible image obtained by developing the latent image onto the transfer paper 16 and the separation of the transfer paper from the photosensitive drum 1 by means of the pick-off blade 12, the separation roller 8 and the separation belt 9 has been described previously. When the copying operation is to be repeatedly performed, the above process is repeated. However, there may be a jamming of transfer paper while is passes through a travelling path T from the registration rollers 2, 4 to the guide plate 17. In such case, it is necessary to remove the jammed paper from the travelling path T.

In removing transfer paper jammed in its travelling path T, the support plate 56 is pivotted downwardly as shown in FIG. 4. Upon this pivot of the plate 56, the separation roller 8, the transfer charger 4, the pressing wire 5, the lower guide plate 6 and the lower registration roller 3, all of which are supported by the support plate 56, are moved downwardly away from the photosensitive drum 1. As a result, a space provided along the transfer paper travelling path T is opened to facilitate the removal of the jammed paper.

In this embodiment, the upper support plate 22 is detachable in a direction normal to the drawing sheet of FIGS. 2 and 4. When, in the state shown in FIG. 2 or 4, the upper support plate 22 is removed, the separation belt 9, the pick-off blade 12 etc. which are supported by the upper support plate 22 are separated from the photosensitive drum 1, providing a larger space in the transfer paper travelling path T to further facilitate removal of jammed paper.

As mentioned previously with respect to FIG. 4, when the lower support plate 56 is moved in the direction away from the photosensitive drum 1, the lower support member 15 is automatically pivotted leftwardly to provide a gap between the pick-off blade 12 and the photosensitive drum 1. This gap helps prevent scratching the surface of the photosensitive drum 1 due to the moving pick-off blade 12 when the upper support plate 22 is moved axially of the photosensitive drum 1. The surface of the photosensitive drum 1 is painted with a cleaning liquid by a cleaning means 60 (FIG. 2) after the transfer operation using the transfer charger 4 is completed. It is also possible to prevent a wetting of the pick-off blade 12 with the cleaning liquid when the upper support plate 22 is removed since the pick-off blade 22 can be separated from the photosensitive drum 1.

Further, since it is possible to put the pick-off blade 12, the separation belt 9 and the separation roller 8 in positions separated from the photosensitive drum 1 by moving the upper and lower support plates 22 and 56, repair and/or cleaning operations for these components are much facilitated.

Although the present invention has been described with reference to the preferred embodiment, it should be noted that the present invention is not limited to it. For example, it is possible to arrange the separation roller 8 which is, in the described embodiment, arranged at the side of the transfer paper travelling path T which is remote from the photosensitive drum 1, at the opposite side and the separation belt 9 at the side remote from the drum 1. Further it is possible to arrange the first and second support plates 22 and 56 side by side instead of the over and under arrangement shown in the drawings, if desired.

Since in the shown embodiment the separation belt 9, the pick-off blade 12 and the upper guide plate 7 are arranged at the side of the travel path T closer to the photosensitive drum 1 and the separation roller 8, the transfer charger 4, the pressing wire 5, the lower guide plate 6 and the lower registration roller 3 are arranged in the remote side thereof, the components including the separation belt 9 etc. arranged at the drum side are mounted on the first, upper support plate 22 and the components including the separation roller 8 etc. arranged at the side remote from the drum are mounted on the second, lower support plate 56. When components other than those mentioned above are to be arranged around the photosensitive drum 1, these components may be mounted on either the upper or the lower support plate dependent upon desired locations for them.

What is claimed is:

1. Apparatus comprising:

a photosensitive member and means for moving transfer paper along a transfer paper travelling path, wherein at least a portion of the transfer paper is pressed against the photosensitive member in a portion of said travelling path;

a pick-off blade which comprises a portion which is between a portion of the transfer paper travelling path and the photosensitive member and separates the leading edge of the transfer paper from the photosensitive member;

a separation belt and a separation roller which face each other and flank a portion of said transfer paper travelling path which is downstream from said pick-off blade;

a first support plate supporting one of said separation belt and separation roller and a second support plate supporting the other one of said separation belt and separation roller;

a mechanism selectively causing relative movement between said first and second support plates, wherein at least one of the plates moves independently of the other relative to the photosensitive member, axially of the photosensitive member.

2. Apparatus as in claim 1 in which in the course of said relative movement the support plates move between a working position, in which they are pressed against each other to feed transfer paper travelling therebetween along said transfer paper travelling path and an unjamming position in which the separation roller and the separation belt are spaced from each other to allow access for removal of jammed transfer paper.

3. Apparatus as in claim 2 in which the transfer belt is mounted to the first support plate and the separation belt is mounted to the second support plate, and wherein the second support plate pivots away from and toward the photosensitive member and the first support plate in the course of said relative movement.

4. Apparatus as in claim 3 including a transfer charger mounted to the second support plate to pivot therewith away from and toward the photosensitive member and the first support plate in the course of said relative movement.

5. Apparatus as in claim 4 including a first guide roller and a second guide roller flanking an initial portion of the transfer paper travelling path, wherein the first guide roller is fixed with respect to the photosensitive member and the second guide roller is mounted to the second support plate to pivot therewith in the course of said relative movement.

6. Apparatus as in claim 5 including a first guide plate and a second guide plate flanking a portion of the transfer paper travelling path which is intermediate said initial portion thereof and the photosensitive member, wherein the first guide plate is fixed with respect to the photosensitive member and the second guide plate is mounted to the second support plate to pivot therewith in the course of said relative movement.

7. Apparatus as in claim 6 including a pressing wire mounted to the second support plate to pivot therewith in the course of said relative movement, wherein in said working position the pressing wire presses the transfer paper against the photosensitive member and in said unjamming position the pressing wire is away from the transfer paper and the photosensitive member.

8. Apparatus as in claim 1 in which the photosensitive member moves about an axis and the first support plate is movable in a direction parallel to said axis between a working position and an unjamming position in which the separation belt and the separation roller are axially spaced from each other.

9. In an apparatus for separating transfer paper attracted to a photosensitive member of a copying machine from said photosensitive member, wherein said paper moves along a transfer paper travelling path, the improvement comprising:

a pick-off blade (12) arranged at the side of the transfer paper travelling path closer to said photosensitive member for separating a front edge of said transfer paper from said photosensitive member;

a separation belt (9) and a separation roller (8) arranged in facing relation to each other, with said transfer paper travelling path being intermediate, for carrying said transfer paper having said front edge separated from said photosensitive member away from the latter member;

a first support plate (22) for supporting said pick-off blade (12) and one of said separation belt (9) and said separation roller (8), said first support plate (22) being detachable in respect to said photosensitive member (1) when moved in a direction which is axial with respect to the photosensitive member; and a second support plate (56) for supporting the other of said separation belt (9) and said separation roller (8);

wherein:

said second support plate (56) is movable in a direction away from said photosensitive member (1) independently of said first support plate (22);

said first support plate (22) is detachable with respect to said photosensitive member (1) axially thereof;

said pick-off blade (12) is separated from said photosensitive member (1) when said second support plate (56) is moved away from said photosensitive member (1); and said first support plate comprises an upper support plate, said second support plate comprises a lower support plate, said separation belt is mounted on said upper support plate, said separation roller is mounted on said lower support plate, and including a spring acting on said separation belt and said separation roller, wherein said separation belt is pivotable downwardly under the influence of the spring so that, when said separation roller is brought into a predetermined position, said separation roller and said separation belt are automatically in contact with each other with a predetermined pressure.

* * * * *